United States Patent [19]

Born

[11] 4,438,830

[45] Mar. 27, 1984

[54] STAIRWAY WITH FAIL SAFE POWER LIFT FOR LADING, THE INFIRM, WHEELCHAIR PATIENTS, AND THE LIKE

[76] Inventor: Raymond W. Born, 4211 First St., Space 121, Santa Ana, Calif. 92703

[21] Appl. No.: 282,424

[22] Filed: Jul. 13, 1981

Related U.S. Application Data

[63] Continuation-in-part of Ser. No. 51,801, Jun. 25, 1979, abandoned.

[51] Int. Cl.[3] ..... B66B 9/06

[52] U.S. Cl. ..... 187/12; 187/32; 198/323

[58] Field of Search ..... 187/10, 12, 13, 14, 187/35, 95, 44, 34, 32, 20, 17; 414/DIG. 921, 539; 182/101, 103; 198/322-324

[56] References Cited

U.S. PATENT DOCUMENTS

| | | | |
|---|---|---|---|
| 266,108 | 10/1882 | Curtis et al. | 187/32 |
| 502,372 | 8/1893 | Moore | 187/32 |
| 753,569 | 3/1904 | Hall | 187/34 |
| 1,838,204 | 12/1931 | Wood | 187/12 |
| 2,637,432 | 5/1953 | Hohnecker | 198/323 |
| 4,046,226 | 9/1977 | Flinchbaugh | 187/12 |
| 4,281,744 | 8/1981 | Koerber | 187/9 R |

*Primary Examiner*—Joseph J. Rolla
*Assistant Examiner*—Kenneth Noland
*Attorney, Agent, or Firm*—Sellers and Brace

[57] ABSTRACT

A combined stairway and power lift installable as a unit between upper and lower levels and including a fluid-powered lifting platform propelled along the stairs over an underlying pressure sensing mat extending beyond the approaches to the stairs and operable to disable the power to the lift and lock the lift stationary whenever and so long as a weight or pressure remains on the mat. Extendable and retractable barriers crosswise on the transverse edges of the lift must be held positively in a barricading position while the lift is en route between levels. The power system includes devices automatically operable to accelerate and decelerate the lift smoothly and shocklessly between zero and full speed while approaching and departing from a floor level as well as safety equipment for safeguarding against travel of the lift under all unsafe contingencies.

34 Claims, 10 Drawing Figures

93
208V.
81
PUMP MTR.
110V.
T
24V.
102
CABLE SW.
99
S.S.
97
SAFE REL.
95
S A
STOP SW.
98
MAT SW.
96
AUX. SAFE REL.
S A A
35
GATE SW.
100
KEY SW.
109
POWER REL.
P O
104
112
P.O.
113
114
STOP SW.
118
PMS
DN.
131
115
UP
119
UP
UP REL.
U P
TLS
130
105
85
SOL.
N.O.
120
UP
116
DN.
DN. REL.
D N
DN.
106
132

STAIRWAY WITH FAIL SAFE POWER LIFT FOR LADING, THE INFIRM, WHEELCHAIR PATIENTS, AND THE LIKE

This application is a continuation-in-part of my application for U.S. Letters Patent Ser. No. 051,801 filed June 25, 1979 now abandoned having the same title as this application.

This invention relates to stairways, and more particularly to an improved stairway embodying fool-proof fail-safe power lift means for use by the infirm, disabled and wheelchair patients without risk of injury to persons on the lift or others endeavouring to use the stairway while the lift is in use.

BACKGROUND OF THE INVENTION

Inclined lifts in a great variety of constructions have been proposed heretofore for transferring both lading and persons between different levels. Representative of the prior proposals are the disclosures in the following U.S. patents: Crispen U.S. Pat. No. 1,473,813; Crispen U.S. Pat. No. 1,535,105; Wood U.S. Pat. No. 1,838,204; Wood U.S. Pat. No. 1,933,131; Miller U.S. Pat. No. 2,563,260; Mazzarelli U.S. Pat. No. 3,121,476; Flinchbaugh U.S. Pat. No. 3,662,859; Pulo U.S. Pat. No. 3,749,202; Cheney U.S. Pat. No. 3,966,022; Ackerman U.S. Pat. No. 4,043,427; Flinchbaugh U.S. Pat. No. 4,046,226; and Wilson U.S. Pat. No. 4,050,546.

These prior constructions are substantially equally divided between those having passenger lifts restricted to one side of a stairway and those extending entirely across the stairway thereby precluding use of the stairway by foot traffic while the lift is in use. Both types are subject to serious shortcomings, disadvantages and pose serious hazards and risks both as respects passengers on the lift and foot traffic endeavouring to use the stairway with or without awareness that the lift is in use. A major need for stairway passenger lifts is to accommodate the infirm, the disabled and the incapacitated. In many instances such persons have infrequent need for transport between two levels whereas the majority of occupants of the premises wish to use the stairway conventionally. Prior to this invention there has been no reliable fool-proof and satisfactory combined stairway and power lift meeting the exacting requirements of both types of traffic and suitable for installation either as original building equipment or later as an adjunct.

SUMMARY OF THE INVENTION

The highly versatile fool-proof self-contained combined stairway and power lift provided by this invention overcomes the serious shortcomings of prior constructions proposed in efforts to meet numerous and varied service requirements. To this end the invention mobile stairway is readily installable as a self-contained unit between two floor levels without need for alteration of an existing structure in any way other than to provide access to its opposite ends of the combined stairway and power lift. The cargo and passenger lift unit extends crosswise of the stairs between its side rails and readily accommodates wheel chair patients and one or two attendants or a like amount of lading. When not is use, the lift has a platform which rests substantially on the floor or pavement at the lower level and is equipped with its own side rails and a normally open gate thereby leaving both the lift platform and the stairway unobstructed and freely useable by foot traffic. When the lift is in use, closure of the gate arms the lift power supply and its control circuit. Shortly following initial movement of the lift at the lower level the gate is positively locked closed and remains locked until the lift returns to the lower level. Coincident with the start of an operating cycle from the upper level, the then extended barrier crosswise of the forward edge of the lift is automatically tilted to its fully retracted upwardly directed position to guard against cargo or the passenger moving onto the stairway. As the lift approaches the upper level this barrier automatically extends and lies flush with the upper landing level until the start of the return trip when it automatically retracts and is firmly so held until the final approach to the lower level.

An important safety provision comprises a sensing mat covering each step and the approach to both the upper and lower level and which functions to deactivate the power circuit should any pressure be placed upon any portion of the mat while the lift power circuit is energized or conditioned for operation. This provides positive assurance against injury or damage to persons or cargo in transit on the lift including persons unwittingly endeavouring to use the stairway while the lift is in use. Another important feature is the provision of means for smoothly and shocklessly accelerating and decelerating the lift between zero and full speed while leaving and approaching at least one level. The lift is powered by pressurized fluid using a linear motor connected to the lift by a double set of cables and a fail-safe brake which sets immediately should the propelling cabling fail.

Accordingly, a primary object of this invention is the provision of a unique and improved fail-safe combined stairway and power lift.

Another object of the invention is the provision of a unitary fail-safe combined stairway and power lift in which the stairway is unobstructed when the power lift is not needed and wherein the stairway is unavailable to foot traffic while the power lift is in use.

Another object of the invention is the provision of a stairway equipped with a safety power lift wherein the stairway equipped with pressure sensing means at both approaches thereto are effective to deactivate the power lift so long as any pressure is sensed thereby.

Another object of the invention is the provision of hydraulically powered apparatus for transferring a load between a plurality of spaced-apart stations equipped with means for automatically and smoothly accelerating and decelerating the load between zero speed and full operating speed as the load departs from and approaches at least one station.

Another object of the invention is the provision of a power lift for a stairway including pressure sensitive sensor means distributed therealong and connected in parallel with the control system of the lift operable to disable the lift incident to the presence of pressure on said sensor means.

Another object of the invention is the provision of an inclined lift equipped with guards along its lateral sides and with retractable and extendable barriers crosswise of its transverse edges which are positively locked in a barricading position while the lift is in use and movable to a non-barricading position leaving the lift unobstructed to passage of foot traffic thereover at other times.

Another object of the invention is the provision of an inclined lift having a normally open gate across one end arranged, when closed, to arm the power control circuit for the lift and to disarm the control circuit as soon as the gate is released from the locked position thereof.

Another object of the invention is the provision of an inclined lift equipped with pressure sensor means in circuit with the power supply to the power means and automatically operable to disable the power means should some object, an animal or a person contact the pressure sensor means overlying the approaches to the upper and lower levels of the lift while it is in use.

Another object of the invention is the provision of a combined stairway and power lift supported on shrouded guideway means for the lift associated with the stairway siderails.

Another object of the invention is the provision of a power lift for use by the infirm, disabled and wheel chair patients while being transported between upper and lower levels in complete safety and comfort.

These and other more specific objects will appear upon reading the following specification and claims upon considering in connection therewith the attached drawing to which they relate.

Referring now to the drawing in which a preferred embodiment of the invention is illustrated:

Figure 1:
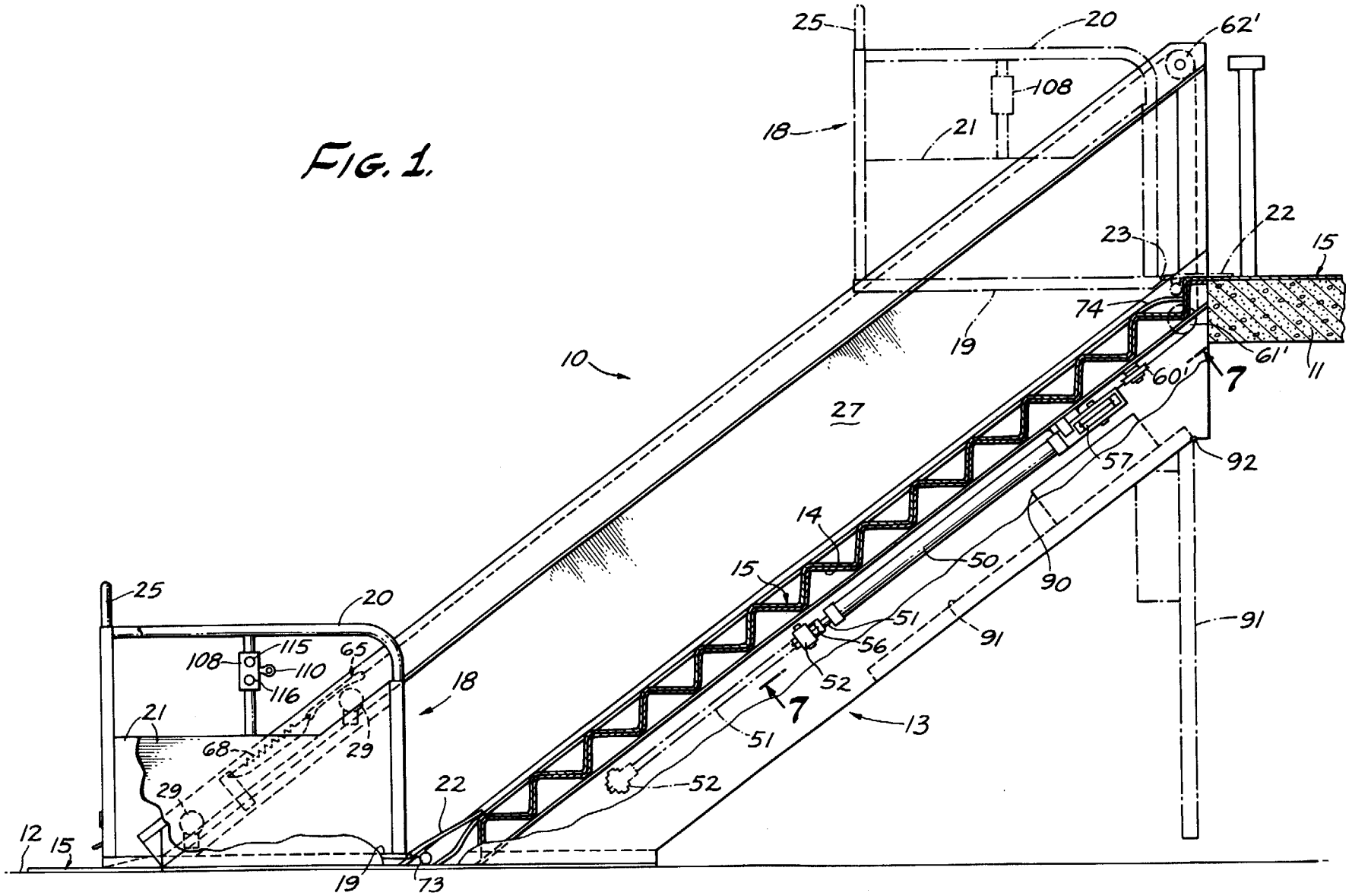
FIG. 1 is a side elevational view, partly in section, showing an illustrative embodiment of the invention installed between ground level and the side of a balcony and showing the power lift in full lines at the lower level with the guard gate closed.

Referring initially more particularly to FIG. 1, there is shown one preferred and illustrative embodiment of the invention combined inclined lift and stairway designated generally 10. This inclined lift is shown installed between one edge of a balcony 11 at the second floor level and the sidewalk 12 of the first floor level. This self-contained unitary apparatus has a main frame 13 formed of suitable structural steel members and includes a stairway 14 and a power lift only of which can be used at the same time. The risers and treads of these stairs are equipped with one or more suitable pressure sensitive mats 15 bonded or otherwise secured thereto.

Preferably and as herein shown, there is a single mat 15 covering an area at the lower level substantially in excess of the size of the lift platform and each stair step and the approach to the stairs at the upper level as is clearly shown in FIG. 1. Mat 15 is of a type well known to persons skilled in the door control and safety arts to control gates and doors in public passageways and includes a multiplicity of parallel-connected switches distributed throughout the length and breadth thereof which close in response to a predetermined weight and functions in this invention to control a power circuit for the lift device as will be explained in greater detail presently. To be noted at this time is the fact that the mat underlies the lift but is out of pressure contact therewith when the latter is stationed at its normal lower level. Under these conditions the lift does not rest directly on the mat but should a person or an object bear on this or any other portion of the mat when someone present on the lift endeavours to use it, the power circuit will be disabled until the person or object is removed.

The lift, designated generally 18, has a load supporting platform 19 extending from side-to-side of stairway 14 between siderails 27 (FIG. 2) and is sufficiently long to accommodate a wheel chair, its occupant and one or two additional persons accompanying the wheel chair. The lift includes siderails 20 and side panels 21, a forward barrier or bridging plate 22 and a rear gate 25. Both the barrier 22 and the gate 25 are movably connected to the lift for movement between their respective extended and retracted positions on their respective barricading and non-barricading positions. For example, bridging plate 22 is hinged transversely of the forward edge of platform 19 by a hinge 23, and gate 25 is connected to the platform by hinges 24 and siderail 20 (FIG. 2).

Figure 5:
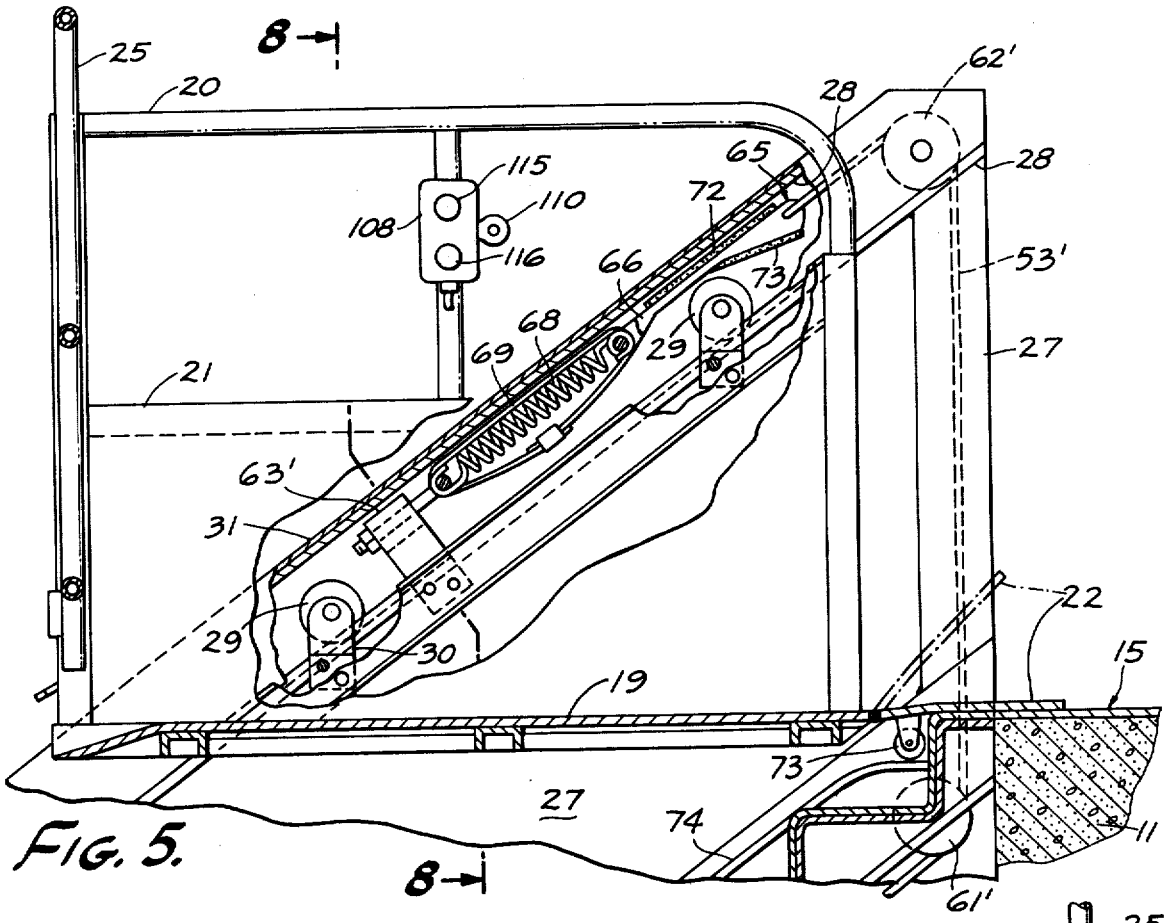
FIG. 5 is a fragmentary view, partly in section, showing the power lift held stationary at the upper level with the bridging plate lowered to provide unobstructed access to and egress from the lift.
Figure 6:
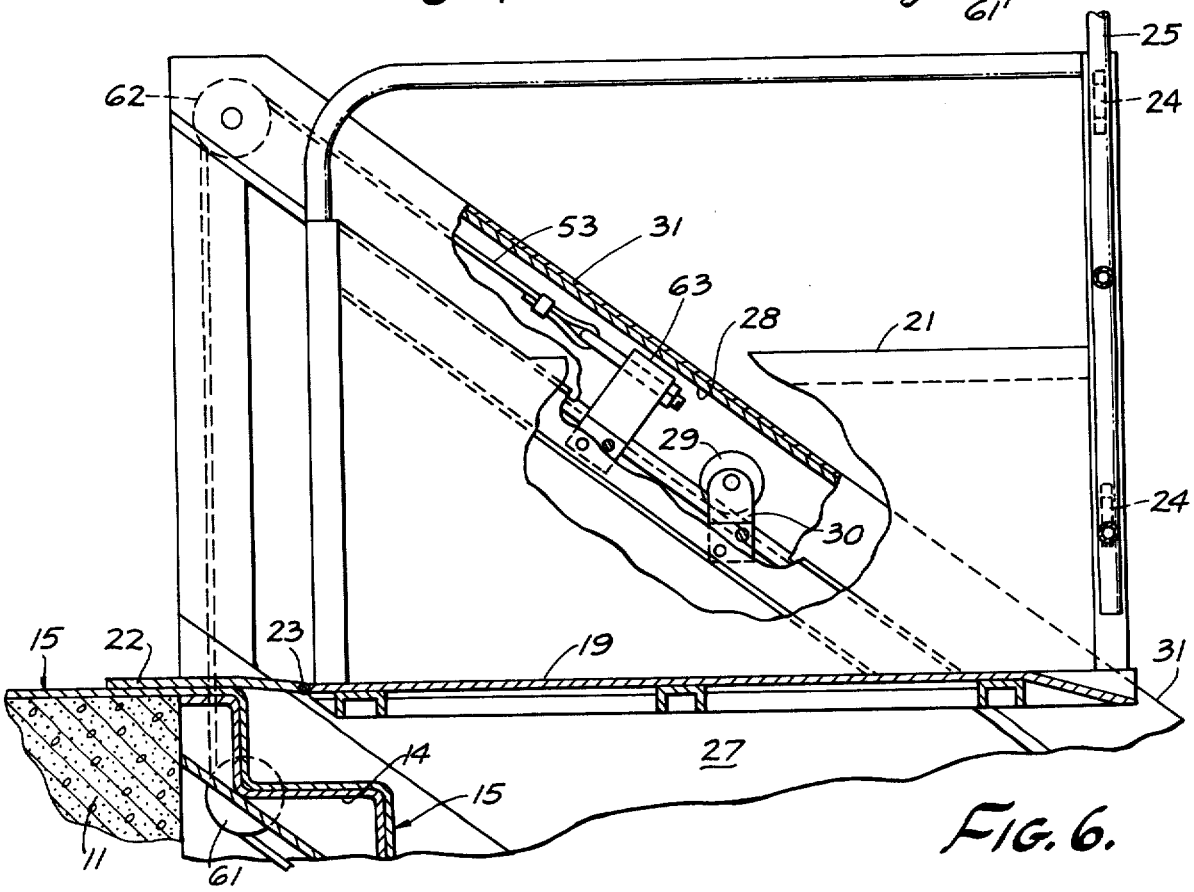
FIG. 6 is a view similar to FIG. 5 but from the opposite side of the lift with parts broken away to show constructional details.
Figure 7:
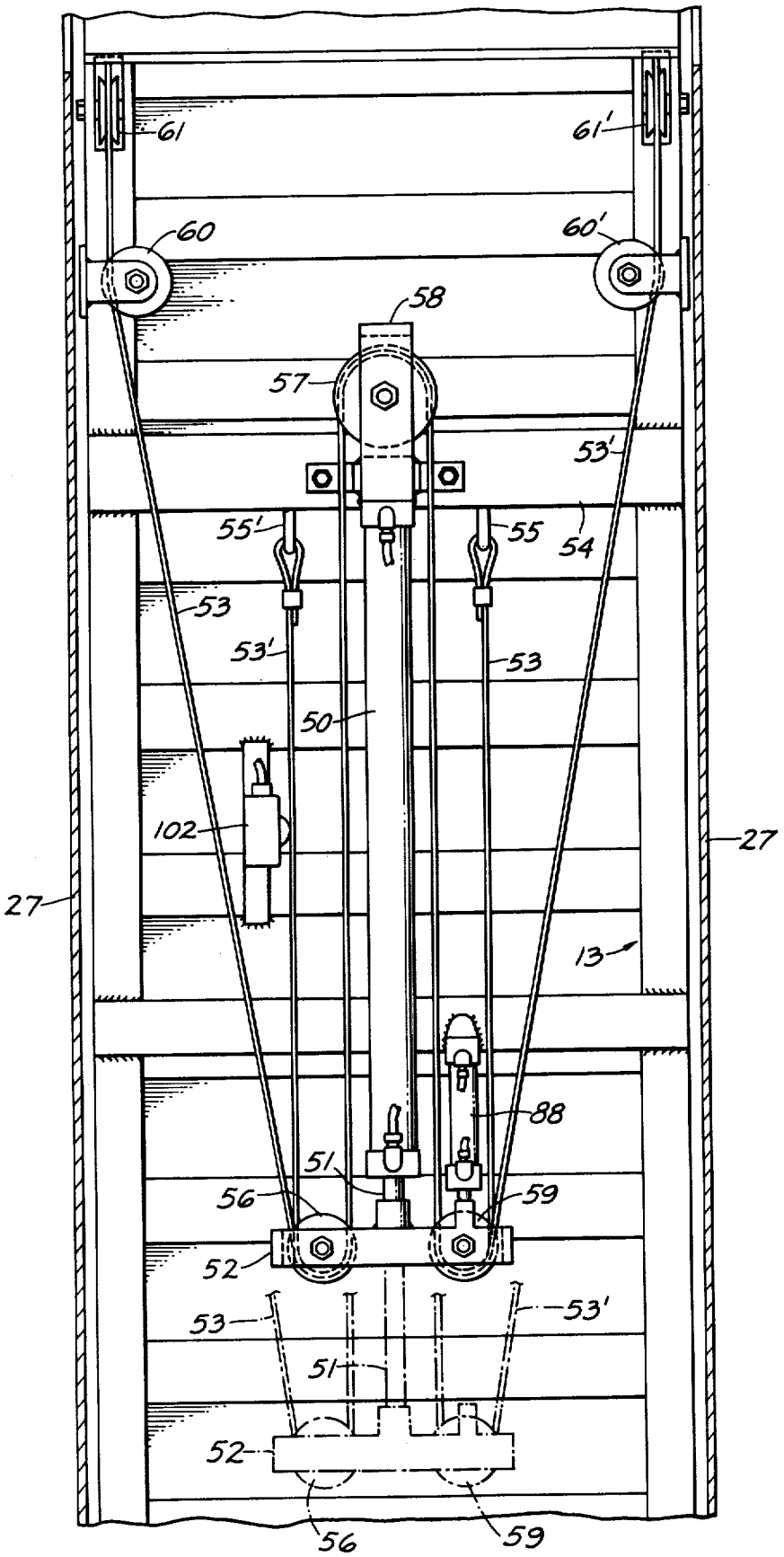
FIG. 7 is a fragmentary view on an enlarged scale taken generally along line 7—7 on FIG. 1 and showing details of the linear fluid motor and its cable connections to the lift.
Figure 8:
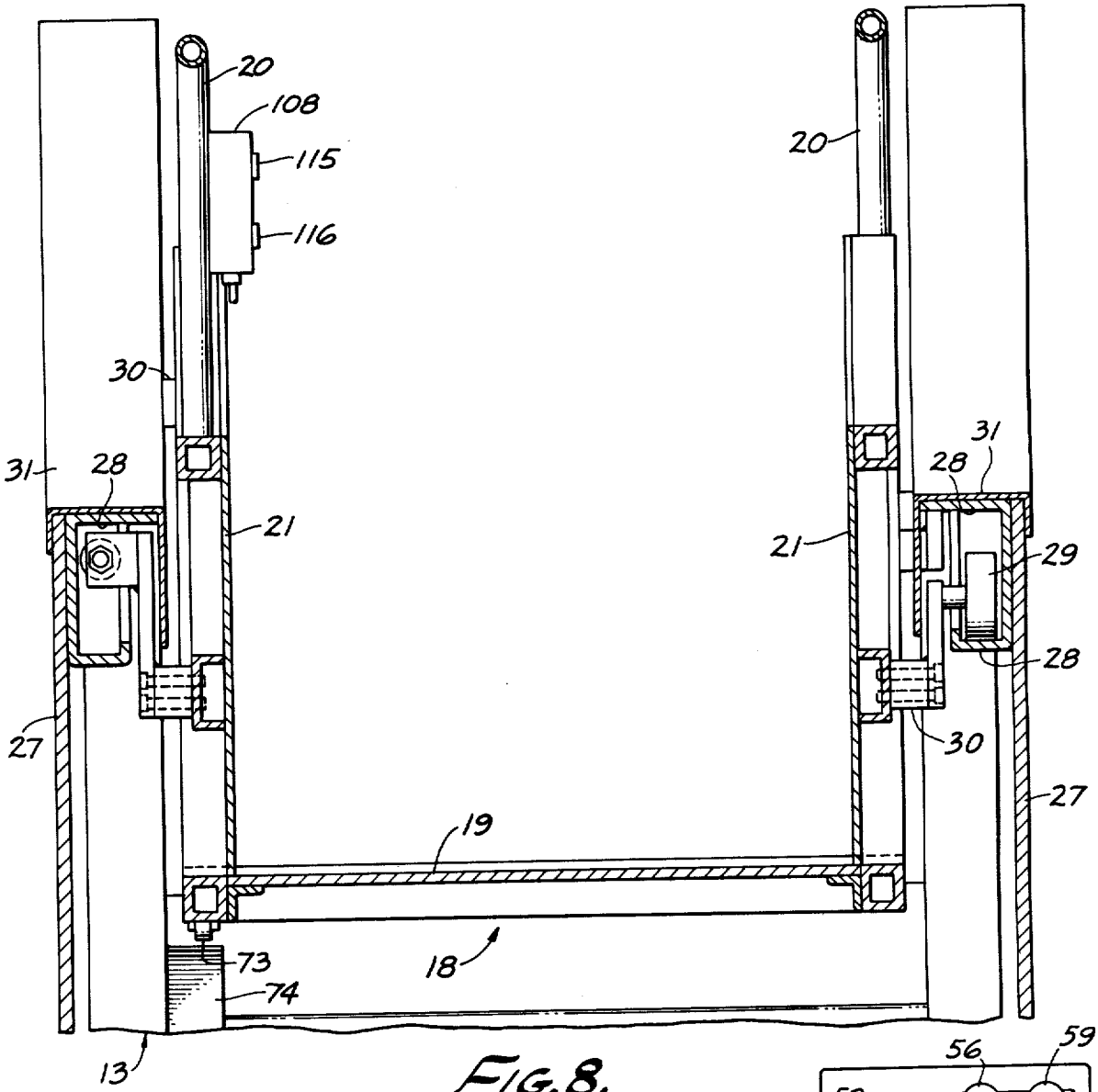
FIG. 8 is a cross sectional view on an enlarged scale taken along the broken line 8—8 on FIG. 5.

Referring to FIGS. 1, 2 and 5 to 8, it will be understood the stairway 14 is provided with siderails 27 along the full length of either side thereof. Secured to the inner faces and along the upper edge of these rails are guide channels for sideways 38 along which lift 18 travels on a three point suspension provided by three rollers 29 connected to lift 18 by brackets 30 (FIGS. 5, 6 and 8). Each of the guide rails is concealed by inverted L-shaped shroud 31—31 overlying and secured to the guideways 28 throughout their length with the longer inner leg of each overlying brackets 30 and concealing the entrance to the guideways. These shrouds not only conceal the guideways or channels but safeguard against the entrance of clothing, objects and the limbs of passengers of the lift or users of the stairway.

Figure 2:
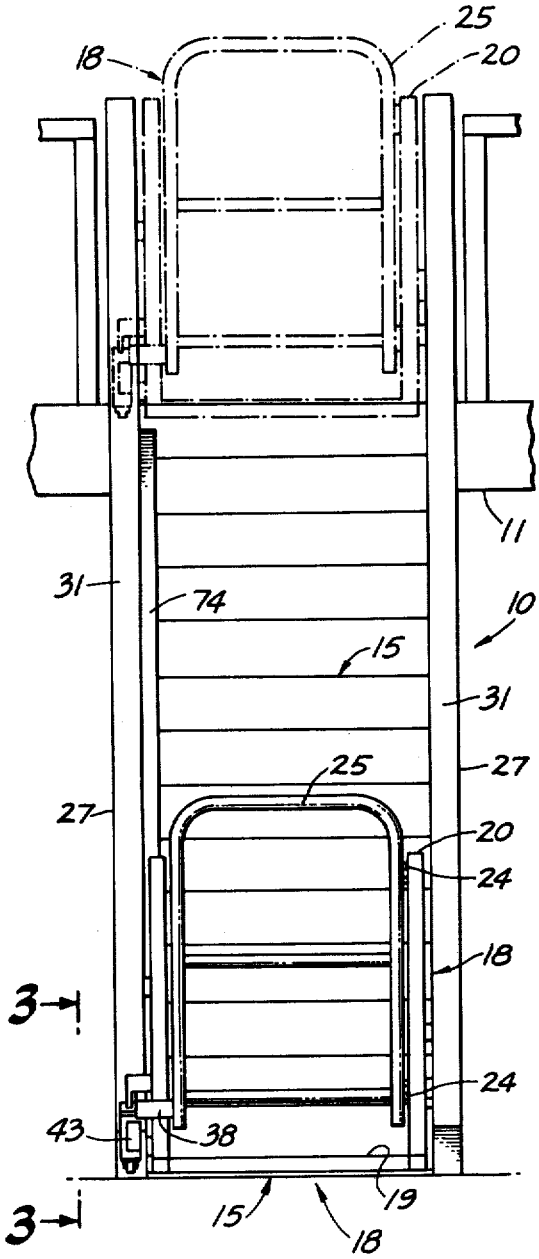
FIG. 2 is an end elevational view on a reduced scale taken from the left hand end of FIG. 1.
Figure 3:
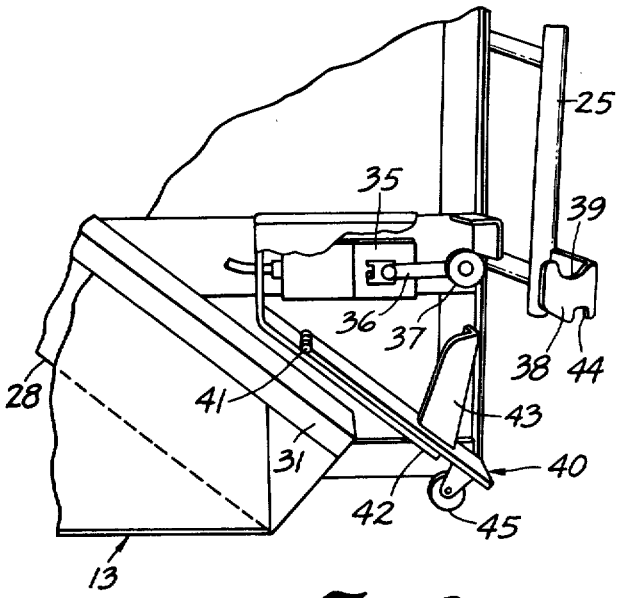
FIG. 3 is a fragmentary view on an enlarged scale taken along line 3—3 on FIG. 2 but showing the gate unlocked and partially open.
Figure 4:
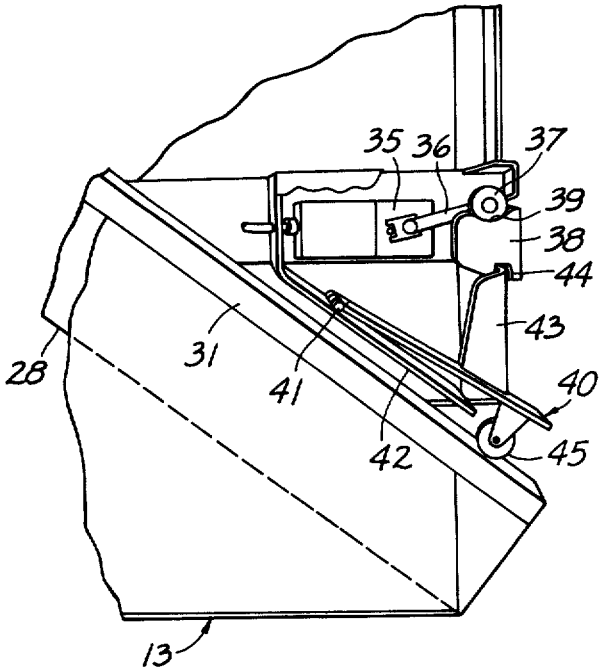
FIG. 4 is a view similar to FIG. 3 but showing the lift momentarily after starting upward from the lower level with the gate locked closed and the arming switch for the power circuit in its enabled position.

Referring now more particularly to FIGS. 2 to 4, the arming switch for the lift control circuit and the locking mechanism for gate 25 will be described. These auxilliaries include an arming or enabling power switch 35 rigidly secured to the left hand side of lift 18 as viewed in FIG. 2. This switch has a pivoting operating arm 36 equipped with a roller 37 at its outer end and is open when gate 25 is open, as illustrated in FIG. 3. Roller 37 is located in the path of an L-shaped latching member 38 carried by gate 25 and its upper edge has an arcuate recess 39 which under-rides and seats roller 37 when gate 25 is in its closed position as shown in FIG. 4. In this position recess 39 supports roller 37 in position to hold switch 35 in its closed position thereby arming the power circuit for the lift, as will be described in greater detail presently. However, at this time gate 25 may be opened or closed since roller 37 readily rides into and out of recess 39 as opening or closing pressure is applied thereto.

Safety latching means to positively guard against opening of gate 25 during travel of the lift along the stairway comprises a locking device 40 hingedly supported by hinge 41 secured to an underlying bracket 42 fixed to lift 18. When the lift is at its lower level, lock 40 rests by gravity against the upper side of bracket 42 and its upwardly projecting detent 43 is disengaged from notch 44 in gate latch 38. However, after the lift has moved a few inches upwardly along the stairway a roller 45, mounted in a bracket fixed to locking device 40, rides upwardly along the top of shroud 31, thereby pivoting device 40 upwardly about the axis of hinge 41 and engages detect 43 in notch 44 of the gate latch 38 thereby locking gate 25 positively closed until lift 18 has returned to the lower level. Roller 45 is no longer supported by shroud 31 and pivots clockwise to the unlocked position shown in FIG. 3. Gate 25, however, remains closed because roller 37 remains seated in recess 39 of gate latch 38. However, roller 37 readily rides out of recess 39 as opening pressure is applied to the gate whereupon roller 37 and its supporting arm 36 gravitates downwardly to open switch 35 thereby disabling the power supply for the lift as will be explained in connection with the description of FIG. 10.

Referring now more particularly to FIGS. 5 to 7, the power unit for lift 18 will be described. FIG. 7 shows this power unit as consisting of a hydraulic cylinder or linear motor 50 suitably rigidly secured lengthwise of the underside of main frame 12. The piston and piston rod 51 of this motor is reciprocable lengthwise of its casing in known manner and is connected to lift 18 by a pair of duplicate cables 53, 53' having one end of each firmly anchored to a crossbrace 54 of the main frame 13 by anchor hooks 55, 55'. Cable 53 extends from bracket 55 over the outer one of a pair of pulleys 56 journalled on bracket 52, then over the outer one of a pair of pulleys 57 journalled in a bracket 58 assured to the upper end of cylinder 50, over the inner one of a pair of pulleys journalled on the other end of bracket 52, and thence over guide pulleys 60, 61, 62 (FIG. 6) to anchor bracket 63 secured to the adjacent siderail 20 of lift 18. The duplicate or redundant cable 53' is similarly trained over the other of each of the duplicate sets of pulleys 56, 57 and 59 and its upper end is connected to lift 18 by a fail-safe brake mechanism 65 in the manner shown in FIG. 5.

Brake 65 includes a main body casting 66 one end of which is connected to cable 53' and the other end of which is connected to bracket 63' by a strong tension spring 68. An equally strong safety cable loop 69 also loosely interconnects brake body 66 and bracket 63' in parallel with spring 68 to safeguard against failure of the brake should spring 68 fail for any reason. Main body 66 of the brake is equipped with brake shoes 72, 73, the outer shoe 72 being disposed to engage the juxtaposed surface of the guideway 28 for the lift and shoe 73 being disposed at an acute angle to shoe 72 and disposed to frictionally engage the upper roller 29 supporting the lift on guide channel 28. It will therefore be recognized that should cable 53' break spring 68 will pull brake 66 towards brackets 63' and jam shoes 72 and 73 between the overlying portion of guideway 28 and roller 29 thereby preventing downward movement of the lift along the stairway should it be in operation when the cable fails. As will be recognized, brake shoe 72 is highly effective in locking the lift against movement whereas shoe 73 is primarily effective in cooperation with roller 29 in jamming shoe 72 against the guard channel.

Another safety feature comprises the bridging plate 22 shown in FIGS. 1, 5 and 6 and hinged at 23 across the forward transverse edge of platform 19. This combination barrier and bridging plate is equipped with a bracket mounted roller 73 which rides along a guideway 74 fixed to or formed by main frame 13. Ramp 74 is so shaped and positioned as to hold barrier 22 elevated at a steep angle, such as indicated in dotted line in FIG. 1, while the lift is in transit between the opposite ends of the stairway. However, upon arrival at the upper level the ramp permits the barrier to pivot into a horizontal position resting against the pressure sensor mat 25, thereby bridging the gap between the forward edge of platform 19 and the upper level of the stairway. As the lift starts it downward travel the barrier is automatically elevated and locked in its safety guard or barricading position throughout the descent cycle. During the approach by the lower level, the depression at the lower end of ramp 74 is so shaped as to permit roller 73 and barrier 22 to pivot downwardly until its forward lip edge rests flush against the edge of the thread on the first stair step. It will be appreciated that the lip of the barrier is shown somewhat elevated in FIG. 1 for clarity of showing but that the parts are so designed and constructed that the lip is flush with the corner edge of the first step and does not present an obstacle or hazard to passage or foot traffic over the stairway while the lift is not in use.

Figure 9:
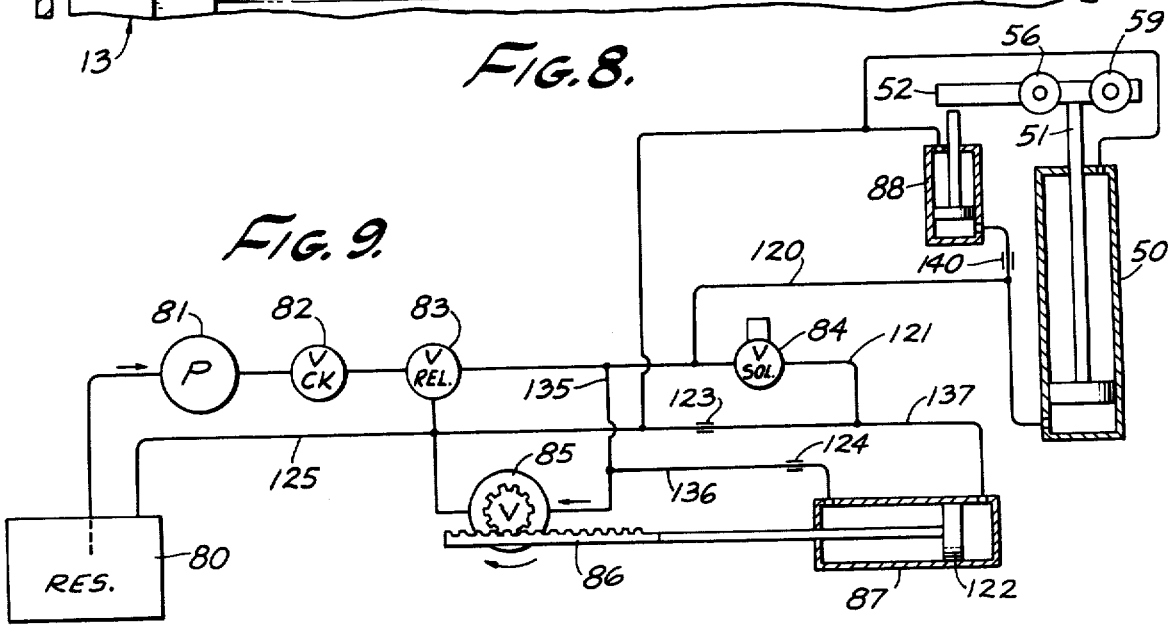
FIG. 9 is a schematic of the fluid power system.

The hydraulic accessories for linear motor 50 are shown in FIG. 9 and include a fluid reservoir 80, a motor pump 81, a check valve 82 a pressure relief valve 83, a normally open solenoid valve 84 and a needle valve 85. Valve 85 is operated by a rack and pinion 86 connected to a speed control cylinder 87 and a decelerator cylinder 88. This cylinder is fixedly mounted on the main frame 13 as shown in FIG. 7 with its piston rod in the path of bracket 52 secured crosswise of the outer end of piston rod 51 of cylinder 50 as this piston rod approaches its fully retracted position. Usually a two inch travel of the piston of decelerator 88 suffices to decelerate lift 18 during its approach to the lower level.

Figure 10:
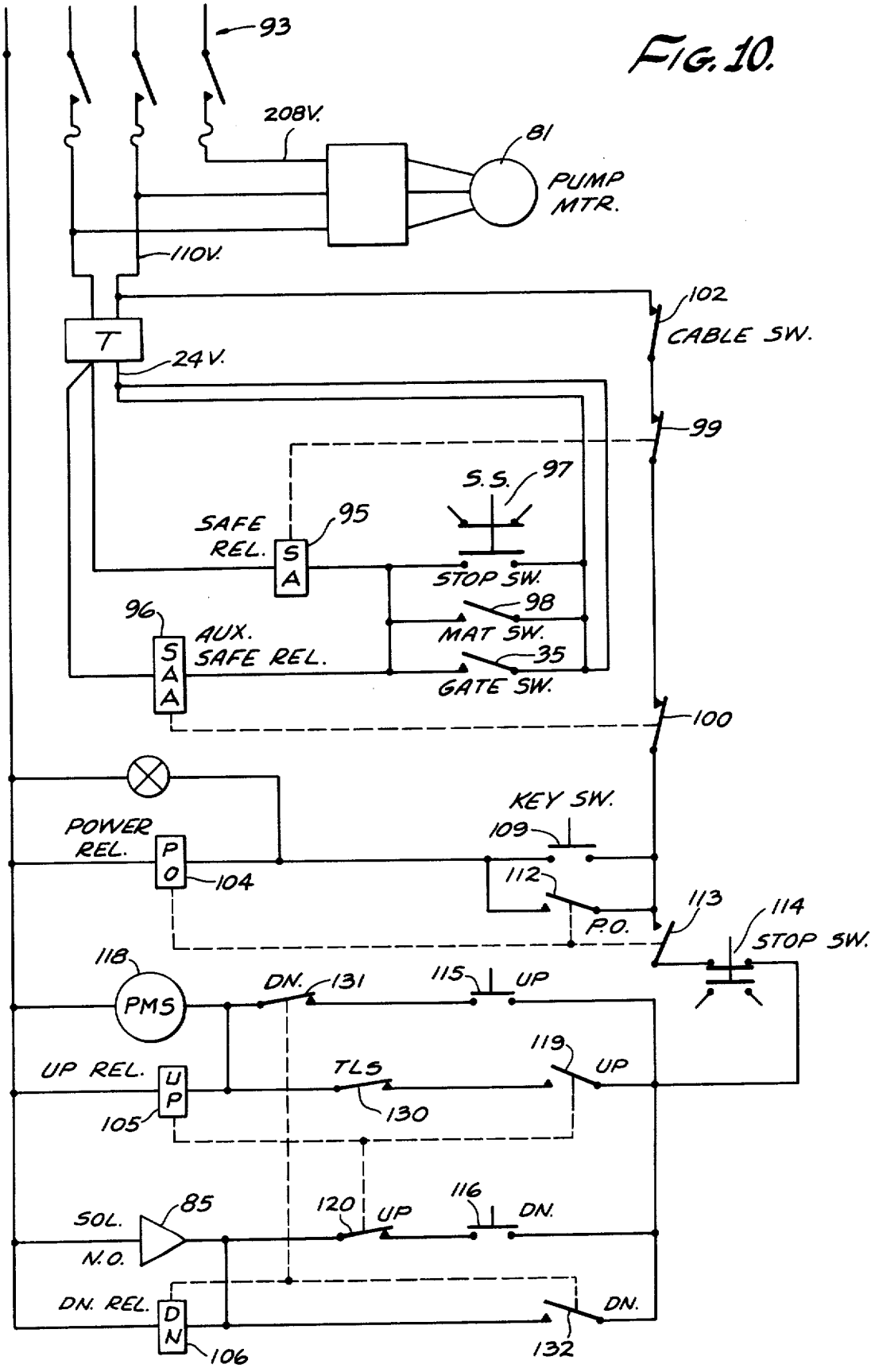
FIG. 10 is a schematic of the electrical system.

The electrical control system is shown in FIG. 10 and its principal components are housed within a control box 90 (FIG. 1) mounted on a support 91 hinged to the main frame 13 at 92. Normally, this panel is held closed in the dotted line position shown in FIG. 1 but can be released to a vertical position for inspection and servicing operations.

Referring to the schematic in FIG. 10, a 208 volt power supply is provided with a master switch 93 and supplies power to the hydraulic pump motor 81 as to a step down transformer T supplying 24 volt power for the control components. Certain other components operate at 110 volts provided by one phase of the three phase power supply. The 24 volt circuit includes a safe relay 95 and an auxiliary safe relay 96 connected in circuit with a "stop" switch 97, the multiplicity of parallel-connected sensor mat switches 98, and the normally open gate switch 35. To be noted in particular is the fact that the important safety switches 35, 97 and 98 and the two safety relays 95 and 96 are provided with separate or redundant power connections to transformer T. In consequence the failure of one redundant connection for any reason does not deprive these important safety accessories of a power supply. Contact 99 of safe relay 95 is normally closed and the same is likewise true of contact 100 of the auxiliary safe relay 96. Likewise, so long as the power cable 53 for the lift is intact and in proper operating condition it holds the control button of the normally open cable switch 102 in closed position. The location of switch 102 is shown on FIG. 7 and this switch is in series with the safety switches 99 and 100 in one side of the 110 volt power supply. Accordingly should any one of these switches open the power supply to the hydraulic components is cut off and the lift if then inoperable.

The 110 volt portion of the schematic appears in the lower half of FIG. 10 and is employed to energize the power relay 104, the "up" relay 105, the normally closed solenoid valve 85 (FIG. 9) and the "down" relay 106. The control box 108 (FIG. 1) of lift 18 is preferably equipped with a key switch 109 which can be closed by the insertion of a key 110 (FIG. 1) in control 108 by any person authorized to use the lift and in possession of key 110. When this key is inserted to close switch 109, power is supplied to relay 104 which is activated to close contact 112 to provide holding current to relay 104 and to close its contact 113 to supply 110 volt power to the electrical components of the lift operating components. The power so supplied passes through the normally closed "stop" switch 114.

OPERATION

The operation of the lift will now be described with the aid of FIGS. 1, 4, 8, 9 and 10. Let it be assumed that a patient in a wheelchair wishes to ascend the stairway to the balcony 11 at the upper level of stairway 13. The person accompanying the patient manoeuvres the wheelchair on to the lift platform 19 and closes the gate 25 to its latched position shown in FIG. 4 wherein the gate operated arming switch 35 is held closed as its roller 37 seats in recess 39, thereby energizing safe relay 95 and the auxiliary safe relay 96 thereby closing contacts 99 and 100 thereby arming the 110 volt power for the lift control panel 108. The attendant or the patient then inserts his key 110 in the control panel and closes key switch 109 momentarily. This activates power relay 104 and provides continuing power to this relay by way of its now closed contact 112 and closes its contact 113 to supply 110 volt power to the power components of lift 18 via the normally closed contacts of "stop" switch 114. The operator then presses the "up" button 115 which activates the up relay 105 which, upon energization, closes its contact 119 to provide a holding circuit for relay 105 and opens its contact 120 thereby assuring that the normally open solenoid valve 84 in the hydraulic circuit (FIG. 9) will remain open even if the person on the lift accidentally closes the "down" control button 116. Closure of the "up" button 115 also activates the starter 118 for the motor driving pump 81.

Pump 81 now begins pumping and supplies pressurized liquid from reservoir 80 to the linear motor 50 by way of check valve 82, relief valve 83 and conduit 120. Also since solenoid valve 84 is normally open substantial portions of the fluid en route to motor 50 goes through valve 84 and to the right hand end of the speed control cylinder 87 via pipe 121 thereby forcing its piston 122 to the left causing the rack and pinion 86 to start closing needle valve 85. During this operation another portion of the pressurized fluid escapes back to reservoir 80 along return conduit 125 by way of each of the flow restrictor valves 123 and 124. It therefore will be recognized that the cooperative action of these two restrictors and the closing of needle valve 85 gradually increases the proportion of pressurized fluid permitted to enter cylinder 50 thereby raising the lift 18 very slowly initially but with increasing acceleration on as needle valve 85 closes. After the lift has ascended a short distance, such as a few inches, the needle valve is closed and substantially the full output of pump 81 is available to elevate the lift relatively rapidly via motor 50 and the two cables 53, 53' connecting this motor to the lift. During travel of the lift upwardly some fluid flows through restrictor 140 and into the deceleration cylinder 88 to extend its piston upwardly. Hence the lower end of cylinder 88 is soon fully charged with fluid soon after the lift leaves the lower level and remains so charged until the lift approaches the lower level during a downward operating cycle. Because of the mode in which the cabling is strung over the several pairs of pulleys 56, 57, 59 it will be recognized that the lift travels four times the piston travel distance of motor 50.

After the lift has travelled a very short distance upwardly from the lower level, roller 45 of the gate locking device 40 rides upwardly on to shroud 31 of the stair railing (FIGS. 3 and 4) so that detent 43 enters notch 44 and locks the arming switch 35 as well as gate 25 positively closed until the lift returns to its lower level allowing roller 45 to roll off from the guide rails and release detent 43 from notch 44.

Also during the initial upward travel movement of the lift, and as is made clear by FIG. 1, roller 73 of the safety barrier and bridging plate 22 rides upwardly along ramp 74 to support barrier 22 inclined steeply upwardly until it rides off ramp 74 at the upper level thereby allowing barrier 22 to rest in a horizontal position on balcony 11. In this latter position barrier 22 bridges the gap between the lift platform and balcony 11.

Owing to the presence of the holding circuits of all three relays 104, 105 and 106, it is unnecessary for the operator to hold key 110 in its operative position or to continue pressure on either of the push buttons 115 or 116 during operation of the lift. Momentary actuation of any one of the three associated switches suffices for self apparent reasons.

As the lift approaches the upper level, the combination barrier and bridging plate 22 automatically pivots to the horizontal position as its support roller 73 rides along the curved upper end of ramp 74 in the manner made clear by FIG. 5.

The lift stops as it contacts the TLS or top limit switch 130 and opens the energizing circuit of the "up" relay 105 thereby deactivating the pump motor starter control 118. The pressurized fluid now remains trapped in motor 50 since it cannot return to the reservoir past either the check valve 82 or the closed needle valve 85, thereby leaving the lift rigidly and immovably supported at the upper level with gate 25 still locked closed.

When the operator wishes to return the lift to the lower level he mades certain that key 110 is in control 108 and then momentarily depresses the "down" button 116. As is made clear by FIG. 10, power is now supplied through the closed "down" switch 116 and the now closed contact 120 to activate both the normally open solenoid valve 84 and the down relay 106 via the normally closed relay contacts 120. Contact 131 of this relay then opens to deactivate the "up" button 115 and its contact 132 doses to maintain relay 106 energized during the return movement of the lift.

To be noted is the fact that the pump motor starter 118 remains deactivated and the return travel of the lift is controlled by the rate at which the fluid trapped within motor 50 is allowed to return to reservoir 80 via the several paths which will now be described by the aid of FIG. 9. Since the solenoid valve 84 as well as needle valve 85 are now closed, liquid from motor 50 escapes via conduit 120, conduits 135 and restrictor 124, into the left hand end of the speed control cylinder 87 via conduits 120, 135, 136 and restrictor 124. The entry of this pressurized fluid into the left end of cylinder 87, forces its piston 122 to the right as viewed in FIG. 9 forcing fluid through conduit 137 and restrictor 123 and conduit 125 back to reservoir 80. As piston 122 shifts rightward, it opens needle valve 85 thereby allowing fluid from cylinder 50 to return to the reservoir at a safe downward travel rate of lift 18. The rate of return increases smoothly and gradually as needle valve 85 is opened by cylinder 87. When open valve 85 remains open throughout the descent of the lift. The lift continues downward at this rate until the bracket 52 on the piston rod of cylinder 50 contacts the upwardly extended piston rod of decelerator piston 88 when lift 18 is about 8 inches above the lower or ground level. The lift then travels very slowly under the control of fluid flow through restrictor 140.

While the particular stairway with fail safe power lift for lading, the infirm, wheelchair patients, and the like herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. Combined stairway and power lift apparatus comprising:

a main frame supporting and fixed to stairs extending from end-to-end thereof;

load supporting platform means having means movably supporting the same on said main frame and including pressurized hydraulic fluid power means mounted on and along the underside of said main frame operable to propel said platform means along said stairs between the upper and lower levels served thereby and generally even with said upper and lower levels of said stairs, said platform means including a first edge relatively close to the tread edges of said stairway and a second edge remote therefrom, means supporting upright gate means on said platform means for swinging movement of said gate means between a closed position generally along said second edge and an open position leaving said second edge unobstructed and designed and constructed to prevent people from walking across said second edge of said platform when said gate means is closed; and said power means including means for automatically and smoothly accelerating said platform means while departing from said upper and lower levels of said stairs by gradually varying the flow of pressurized fluid to and from said hydraulic power means between no flow and full flow.

2. Combined stairway and lift apparatus as defined in claim 1 characterized in the provision of operator actuatable means for activating said power means provided said gate is in said closed position.

3. Combined stairway and lift apparatus as defined in claim 2 characterized in the provision of means responsive to the movement of said platform away from said lower level to lock said gate in said closed position.

4. Combined stairway and lift apparatus as defined in claim 2 characterized in the provision of means for locking said gate positively closed so long as said platform means is beyond a predetermined level above said lower level.

5. Combined stairway and lift apparatus as defined in claim 1 characterized in that said platform means includes a bridging plate movably supported along said first edge of said platform means and close to the tread edges of said stairway, and means for holding said bridging plate retracted while said platform means is positioned between said upper and lower levels.

6. Combined stairway and lift means as defined in claim 5 characterized in that said means for holding said bridging plate retracted is automatically operable to retract and to extend the same as said platform means leaves and approaches each of said upper and lower levels.

7. Combined stairway and lift as defined in claim 6 characterized in that bridging plate holding means is operable to hold the same inclined rigidly upwardly above the load supporting surface of said platform means so long as said platform is located between said upper and lower levels.

8. Combined stairway and lift as defined in claim 6 characterized in that bridging plate holding means is operable to support said bridging plate in a retracted position spaced above and overlying the stair tread edges while said platform means is located between said upper and lower levels thereby safeguarding against any object carried on said platform means becoming trapped between the edge of a stair tread and the adjacent transverse edge of said platform means.

9. Combined stairway and lift apparatus as defined in claim 6, characterized in the provision of means for automatically locking said gate closed and retaining the same locked so long as said platform means is in any position above a predetermined lower position.

10. A safety power lift for use between the upper and lower levels of a building stairway comprising:

a stairway;

a horizontally disposed load carrying platform movable along guideway means rigidly supported along the side of said stairway between the upper and lower levels thereof;

power means including control means therefor operable to transfer said platform between said upper and lower levels said power means including hydraulic motor means mounted along the underside of said guideway means and which power means provides for smooth acceleration by varying the flow of pressurized fluid between no flow and full flow; and weight sensor means supported by and extending along said stairway and along the approaches thereto at said upper and lower levels operable to deactivate said control means so long as a weight in excess of a predetermined value is present on any portion of said sensor means.

11. A safety power lift as defined in claim 10 characterized in that said control means includes an actuator mounted on said platform and operable by an operator located on said platform.

12. A safety power lift as defined in claim 11 characterized in that said control means is operable only by the insertion of a removable key carried by a person authorized to use said lift.

13. A safety power lift as defined in claim 10 characterized in that one transverse edge of said platform is closely spaced from the treads of said stairway as the platform moves therepast, a normally open gate mounted for swinging movement between an open position and a closed position overlying the opposite transverse edge of said platform when said lift is in use, and means operatively connected to said control means and actuatable by said gate when closed to arm said control means and render the same effective to control said power means.

14. A safety power lift as defined in claim 10 characterized in that the transverse edge of said platform remote from the treads of said stairway is provided with a gate swingable between a normally open position to one side of said platform and a closed position overlying said transverse edge, and means for automatically locking said gate closed while said platform is positioned between said upper and lower levels.

15. A safety power lift as defined in claim 12 or 14 characterized in that said gate includes means operable to disable said control means whenever said gate is not in said closed position and irrespective of whether said platform is at said lower level or at any level thereabove.

16. A safety power lift as defined in claim 10 characterized in that said power means includes hydraulic motor means connected to said platform by cabling operable to transfer said platform between said upper and lower levels.

17. A safety power lift as defined in claim 16 characterized in that said cabling is connected to said platform by spring powered braking means operable to arrest the movement of said platform at any point between said upper and lower levels should said cabling fail and which braking means is normally held retracted so long as said cabling connection between said platform and said hydraulic cylinder means remains intact.

18. A safety power lift as defined in claim 17 characterized in the provision of normally inactive safety connection means in parallel with the spring of said spring powered braking means and effective to set said brake in response to failure of said spring.

19. A safety power lift as defined in claim 13 characterized in that said stairway is equipped with siderails along either side thereof, said guideway means for said platform embodied in said siderails and substantially concealed thereby.

20. A safety power lift as defined in claim 10 characterized in the provision of means for automatically accelerating and decelerating said platform as the same departs from and approaches said upper and lower levels.

21. A safety power lift as defined in claim 20 characterized in that said accelerating and decelerating means include hydraulic motor and flow restrictor means in circuit therewith operable to move said platform.

22. A safety power lift as defined in claim 10 characterized in bridging plate means pivotably mounted along the edge of said platform closest to and parallel to the stair treads, and means for moving said bridging plate between a retracted travel position when said platform is located in an intermediate position between said upper and lower levels and, alternatively, in an extended position bridging the gap between said platform and the adjacent stair tread when said platform is at one of said upper and lower levels.

23. A safety power lift as defined in claim 22 characterized in the provision of means responsive to the approach of said platform to and recession of said platform from said upper and lower levels to extend and to retract said bridging plate.

24. A safety power lift as defined in claim 23 characterized in that said bridging plate is pivotally connected to said platform transversely thereof for swinging movement between a generally horizontal extended position and an upwardly inclined retracted position serving as a safety barrier against shifting of lading off said platform onto said stairs while said platform is in a travel mode.

25. A safety power lift as defined in claim 10 characterized in that said guideway means extend along either lateral side of said stairway and are rigidly fixed thereto, roller means mounted along either lateral side of said platform and rollingly supported by said guideway means, and shroud means along either side of said stairway and either side of said platform cooperating to guard against an object on said platform entering said guideway means and becoming injured or damaged.

26. Power operated lifting apparatus for transferring lading between upper and lower levels comprising:

rigid frame means having a pair of parallel guideway means adapted to be firmly supported between said upper and lower levels;

a horizontal load supporting platform equipped with rollers confined to movement along said guideway means;

hydraulic power means operatively connected to said platform for moving the same between said upper and lower levels, and including control means for said power means and arming means for said control means, said power means including hydraulic motor means mounted along the underside of said guideway means and which power means provides for smooth acceleration by varying the flow of pressurized fluid between no flow and full flow;

gate means movable between open and closed positions transversely of one end of said platform employed for egress and ingress; and pressure sensitive mat means positioned on the floor at said upper and lower levels, said mat means being operatively connected to said arming means and responsive to the presence of a weight thereon at either of said upper and lower levels to disable said arming means so long as said weight is present and to enable said arming means while said mat means are free of weight thereon.

27. A safety power lift as defined in claim 26 characterized in the provision of means carried by said platform operable to lock said arming means for said power control means in the armed position after said platform moves a predetermined distance above said lower level and to retain the same armed so long as said platform is in any position above said predetermined position.

28. A safety power lift as defined in claim 27 characterized in the provision of means normally holding said gate open when said platform is stationed at said lower level thereby leaving said arming means disabled and said stairway and platform unobstructed and available for use by foot traffic, and whereby said gate, when closed, precludes passage of foot traffic over said stairway and said platform.

29. Power lifting apparatus as defined in claim 26 characterized in the provision of second arming means for said control means which is normally disabled so long as said gate is open, and means responsive to the closing of said gate to enable said second arming means.

30. Power lifting apparatus as defined in claim 29 characterized in the provision of means for locking said gate positively closed while in transit between said upper and lower levels.

31. A self-contained stairway and power lift apparatus comprising:

an elongated main frame equipped with stairs and siderails from end-to-end thereof and suitable for use by foot traffic between upper and lower levels;

power driven lift means accommodating a wheelchair supporting passenger platform rollingly supported for movement along guideways carried by said siderails between said upper and lower levels and powered by hydraulic motor means secured to said main frame and connected to said lift means by cabling;

barrier means movable between extended and retracted positions across the opposite transverse ends of said lift means; and means for holding each of said barrier means in the extended position thereof while said lift means is in use thereby preventing foot traffic along said stairway between said upper and lower levels, and said barrier means each being movable to the retracted positions thereof when said lift means is at said lower level thereby leaving said stairway unobstructed for free passage of foot traffic thereby.

32. A stairway and power lift as defined in claim 31 characterized in the provision of means for holding both of said barrier means positively in the extended position thereof while said lift means is positioned intermediate said upper and lower levels.

33. A stairway and power lift apparatus as defined in claim 32 characterized in the provision of weight sensing mat means extending along said stairs and over the floor adjacent the upper and lower levels thereof and normally enabling the operation of said power driving lift means, and said sensing mat means being operable to disable said power driven lift means when a weight in excess of a predetermined value is resting thereon.

34. A stairway and power lift apparatus as defined in claim 31 characterized in the provision of means enclosing said cabling and the rolling support for said platform along said guideways between said upper and lower levels.

* * * * *